US006906675B2

(12) United States Patent
Satoh et al.

(10) Patent No.: US 6,906,675 B2
(45) Date of Patent: Jun. 14, 2005

(54) MULTI-BAND ANTENNA APPARATUS

(75) Inventors: Yoshihiro Satoh, Kawagoe (JP); Akira Ezaki, Rochester (GB); Kazuhumi Sato, Kawasaki (JP)

(73) Assignee: Harada Industry Co., Ltd., Tokyo (JP)

( * ) Notice: Subject to any disclaimer, the term of this patent is extended or adjusted under 35 U.S.C. 154(b) by 30 days.

(21) Appl. No.: 10/422,392

(22) Filed: Apr. 24, 2003

(65) Prior Publication Data

US 2004/0017325 A1 Jan. 29, 2004

(30) Foreign Application Priority Data

Apr. 26, 2002 (JP) ..... 2002-126425

(51) Int. Cl.[7] ..... H01Q 13/10

(52) U.S. Cl. ..... 343/767; 343/700 MS; 343/770

(58) Field of Search ..... 343/700 MS, 767, 343/770, 795

(56) References Cited

U.S. PATENT DOCUMENTS 5,355,143 A 10/1994 Zurcher et al. ..... 343/700
5,563,616 A * 10/1996 Dempsey et al. ..... 343/753
5,696,372 A * 12/1997 Grober et al. ..... 250/216
6,529,170 B1 * 3/2003 Nishizawa et al. ..... 343/795

FOREIGN PATENT DOCUMENTS

WO WO 99 63618 A 12/1999

OTHER PUBLICATIONS

Puente C et al., "*Analysis of Fractal–Shaped Antennas Using The Multiperiodic Traveling Wave Vee Model*", IEEE Antennas and Propagation Society International Symposium, 2001 Digest. Aps. Boston, MA, Jul. 8–13, 2001 New York, NY: IEEE, US, vol. 3 of 4, Jul. 8, 2001, pp. 158–161 XP001072274. EP Search Report dated Sep. 1, 2003 from EP 03252620.4.

* cited by examiner

*Primary Examiner*—Hoang V. Nguyen
(74) *Attorney, Agent, or Firm*—Ohlandt, Greeley, Ruggiero & Perle L.L.P

(57) ABSTRACT

A multi-band antenna apparatus comprises a first conductor and a second conductor arranged with a specific interval and a feeder which feeds power to the first conductor and the second conductor, and the first conductor is divided by a slit.

18 Claims, 2 Drawing Sheets

MULTI-BAND ANTENNA APPARATUS

CROSS-REFERENCE TO RELATED APPLICATIONS

This application is based upon and claims the benefit of priority from the prior Japanese Patent Application No. 2002-126425, filed Apr. 26, 2002, the entire contents of which are incorporated herein by reference.

BACKGROUND OF THE INVENTION

1. Field of the Invention

The present invention relates to a multi-band antenna apparatus for transmitting and receiving in a plurality of frequency bands by one antenna.

2. Description of the Related Art

It is planned in a near future to realize an emergency information system called Telematics system in Japan. This system operates as follows. If an automobile accident occurs, for example, the accident is detected. The vehicle position is automatically calculated by receiving a radio wave from a global positioning system (GPS). On the basis of the calculated information of the vehicle position, it is automatically noticed by a mobile phone.

Telematics system requires, for the ease of installation of the apparatus in an automobile, a multi-band antenna integrally combining an antenna for receiving GPS waves in a band of, for example, about 1.6 GHz, and an antenna for transmitting and receiving radio waves for mobile phone in a band of 880 MHz.

BRIEF SUMMARY OF THE INVENTION

According to an aspect of the present invention, there is provided a multi-band antenna apparatus high in antenna efficiency in a wide band, and easy in setting of desired frequency band.

A multi-band antenna apparatus according to an aspect of the invention is characterized by comprising: a first conductor and a second conductor arranged at a specific interval; and a feeder which feeds power to the first conductor and second conductor, wherein the first conductor is divided by at least one slit.

In a frequency band higher than a specific frequency, by feeding power by parasitic method by using the slit, the plurality of antenna elements can be coupled to function as one antenna element. Accordingly, by adjusting the width and interval of the slit, the antenna efficiency is enhanced in a wide band, and it is easy to set the desired frequency band.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

An embodiment of the invention applied in an antenna apparatus of Telematics system is described below while referring to the accompanying drawings.

Figure 1:
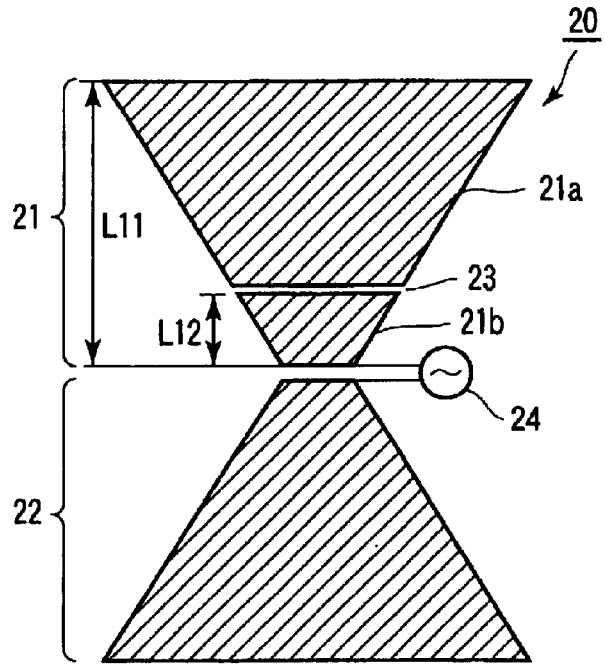
FIG. 1 is a diagram showing a configuration of dipole antenna of bowtie type according to an embodiment of the invention.

FIG. 1 is a diagram showing a configuration of application in a dipole antenna of bowtie type (hereinafter called bowtie antenna) 20.

In FIG. 1, shorter bottoms of trapezoidal hot-side element 21 and ground-side element 22 are formed face to face on an antenna substrate (not shown) by a copper foil printing pattern or the like. By feeding power to the opposing positions from power feeder 24, the bowtie antenna 20 is configured.

At the hot-side element 21, in particular, a slit 23 with a specific width of, for example, 0.2 mm is formed at a position of a distance L12 from the power feed position. As a result, the hot-side element 21 is divided into a first antenna element 21*a* and a second antenna element 21*b*.

The specific configuration will be described.

The position of the distance L12 from the power feed position is adjusted to a quarter wavelength of GPS wave in 1.6 GHz band, so that the second antenna element 21*b* functions as a GPS receiving antenna.

On the other hand, a distance L11 from the power feed position to an end point not close to the first antenna element 21*a* and second antenna element 21*b* is adjusted to a quarter wavelength of mobile phone wave of 880 MHz band, so that the first antenna element 21*a* and second antenna element 21*b* function as antennas for transmitting and receiving waves of the mobile phone.

In this case, the slit 23 feeds power between the first antenna element 21*a* and the second antenna element 21*b* by a parasitic method, and couples the antenna elements 21*a* and 21*b* to function as one antenna element.

In this way, by feeding power between the hot-side element 21 and the ground-side element 22 formed by interposing the slit 23 between the antenna elements 21*a* and 21*b* with the power feeder 24, a two-band antenna can be realized for the mobile phone antenna by the first antenna element 21*a* and second antenna element 21*b*, and for the GPS receiving antenna by the second antenna element 21*b* only.

Figure 2A:
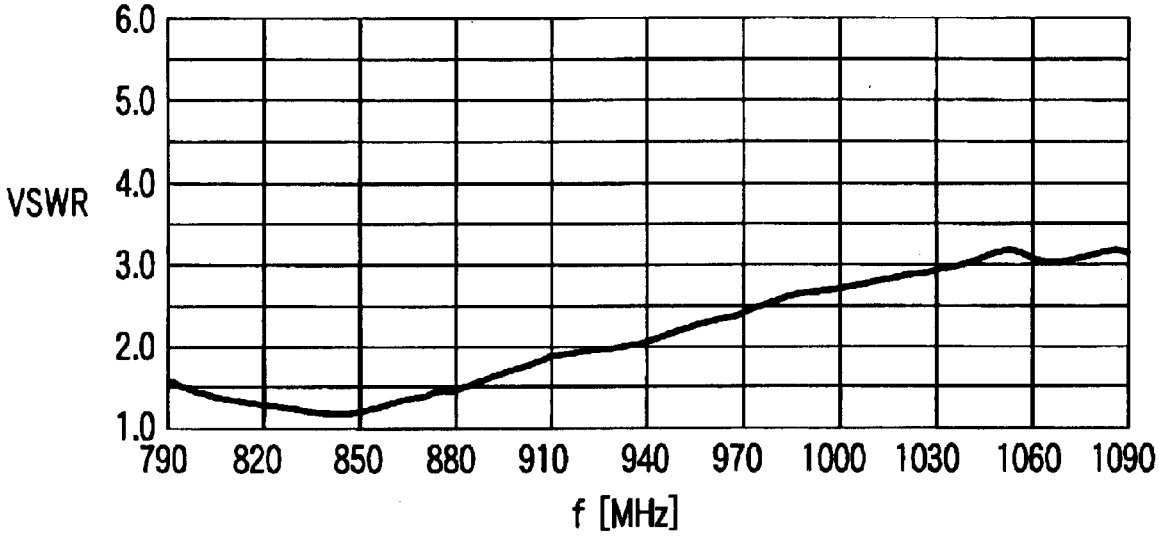
FIG. 2A and FIG. 2B are views showing examples of results of measurement of VSWR in a range including two frequency bands in the same embodiment.
Figure 2B:
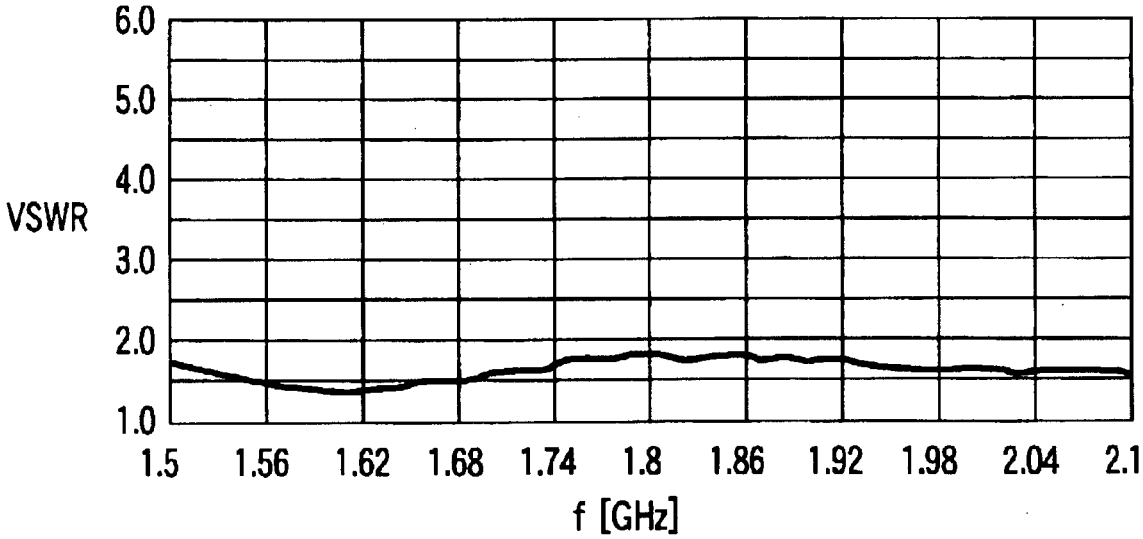

In such configuration, results of measurement of VSWR (voltage stationary wave ratio) are shown in FIG. 2A and FIG. 2B.

FIG. 2A shows results of measurement in a range of 790 MHz to 1090 MHz including the mobile phone frequency band by the first antenna element 21*a* and second antenna element 21*b* by way of the slit 23.

FIG. 2B shows results of measurement in a range of 1.5 GHz to 2.1 GHz including the GPS frequency band by the second antenna element 21*b* only.

In the range including the mobile phone frequency band shown in FIG. 2A, the VSWR of 2.0 or less is obtained from a low frequency band of 790 MHz up to about 930 MHz, and it is understood to be sufficiently practicable.

On the other hand, in the range including the GPS frequency band shown in FIG. 2B, the VSWR is 2.0 or less in the entire range, and the antenna efficiency is very high, and it is proved that the supplied electric power can be utilized efficiently.

Thus, in the bowtie antenna apparatus, by adjusting the shape of the antenna elements 21*a*, 21*b* and the width and interval of the slit, the antenna efficiency becomes higher in a wider band, and the intended frequency band can be set easily.

The width of the slit 23 has been verified to function favorably as parasitic power feeder at the interval of 0.1 mm to 0.3 mm. However, the appropriate interval and width vary with the shape of the antenna element or frequency band.

It has been proved by measurement that the slit 23 is small in loss and effective in parasitic current feed in a frequency band generally higher than decimeter waves (300 MHz to 3 GHz).

The above-mentioned embodiment is an antenna apparatus for Telematics system, realizing a two-band antenna for the GPS wave receiving antenna in 1.6 GHz band, and the mobile phone wave transmitting and receiving band in 880 MHz band, but the invention is not limited to the present embodiment, but three-band or more multi-band antenna apparatus can be easily configured.

Figure 3:
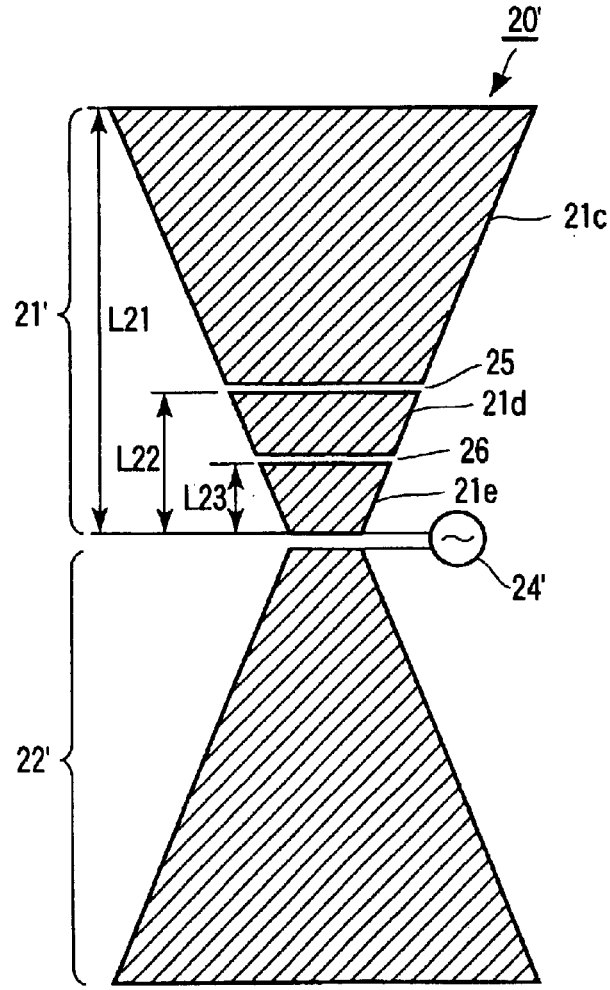
FIG. 3 is a diagram showing a configuration of another example of a dipole antenna of bowtie type of the same embodiment.

FIG. 3 is a diagram showing a configuration of a bowtie antenna 20' for three-band frequency. In FIG. 3, shorter bottoms of trapezoidal hot-side element 21' and ground-side element 22' are formed face to face on an antenna substrate (not shown) by a copper foil printing pattern or the like. By feeding power to the opposing positions from power feeder 24', the bowtie antenna 20' is configured.

At the hot-side element 21', slits 25 and 26 with a specific width of, for example, 0.2 mm are formed at two points, that is, a position at a distance L23 from the power feed position and at a position at a distance L22. As a result, the hot-side element 21' is divided into a first antenna element 21*c*, a second antenna element 21*d*, and a third antenna elements 21*e*.

In this case, as similar to the above-mentioned embodiment, the distance L23 from the power feed position to the slit 26 is adjusted to a quarter wavelength of third frequency band f23, so that the third antenna element 21*e* alone functions as a antenna for transmitting and receiving waves of the third frequency band f23.

On the other hand, the distance L22 from the power feed position to the slit 25 is adjusted to a quarter wavelength of second frequency band f22, so that the second antenna element 21*d* and third antenna element 21*e* function as antennas for transmitting and receiving waves of the second frequency band f22.

Moreover, the distance L21 from the power feed position to an end side of the second antenna element 21*d* not contacting with the first antenna element 21*c* is adjusted to a quarter wavelength of the first frequency band f21, so that the first to third antenna elements 21*c* to 21*e* are bound together across the slits 25, 26 so as to function as an antenna for transmitting and receiving waves of the first frequency band f21.

The antenna type is not limited to the print type dipole antenna, but it can be applied in antennas of various element configurations.

It is not limited to the above-mentioned embodiment, the invention may be modified and embodied in several modes within the scope of the invention.

Further, the present embodiments includes various stages of inventions, and various inventions may be devised by properly combining the disclosed a plurality of constituent requirements. For example, if certain constituent requirements are deleted from the entire constituent requirements of the embodiment, the configuration deleting such constituent requirements may be devised as an invention as far as at least one of the problems to be solved by the invention can be solved and at least one of the effects of the invention is obtained.

According to the embodiment of the invention, in a higher frequency band than a specific frequency, by parasitic power feed by using the slit, the plurality of antenna elements can be coupled to function as one antenna element. Hence, by adjusting the width or interval of the slit, the antenna efficiency is high in a wide band, and the intended frequency band can be set easily.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multi-band antenna apparatus comprising:

a first conductor and a second conductor being arranged with a specific interval; and a feeder for feeding power to the first conductor and the second conductor, wherein the first conductor is divided into a first portion and a second portion by a slit, and wherein the first portion and the second portion are not electrically connected by a conductor.

2. The multi-band antenna apparatus according to claim 1, wherein the first conductor and second conductor each have a shape that is trapezoidal, and the first conductor and second conductor are arranged such that a shorter bottom side of the first conductor and the second conductor face each other, and the feeder is connected to the shorter bottom sides of the first conductor and the second conductor.

3. The multi-band antenna apparatus according to claim 2, wherein the slit is parallel to the shorter bottom side of the first conductor.

4. The multi-band antenna apparatus according to claim 3, further comprising a distance between the slit and the shorter bottom side of the first conductor that is equivalent to a quarter wavelength of a desired first frequency.

5. The multi-band antenna apparatus according to claim 2, further comprising a distance between a longer bottom side and the shorter bottom side of the first conductor that is equivalent to a quarter wavelength of a first frequency.

6. The multi-band antenna apparatus according to claim 5, wherein the distance between the slit and the shorter bottom side is equivalent to a quarter wavelength of a second frequency different from the desired first frequency.

7. The multi-band antenna apparatus according to claim 1, wherein the first conductor, second conductor and the feeder comprises a bowtie antenna.

8. The multi-band antenna apparatus according to claim 1, wherein the slit has a width ranging from about 0.1 mm to about 0.3 mm.

9. The multi-band antenna apparatus according to claim 1, wherein the first conductor is divided by a plurality of slits.

10. The multi-band antenna apparatus according to claim 9, wherein the first conductor and second conductor each have a shape that is trapezoidal, and the first conductor and second conductor are arranged such that a shorter bottom side of the first and second conductors face each other, and the feeder is connected to the shorter sides of the first conductor and the second conductor.

11. The multi-band antenna apparatus according to claim 10, wherein at least one of the plurality of slits is parallel to the shorter bottom side of the first conductor.

12. The multi-band antenna apparatus according to claim 11, further comprising a distance between one of the plurality of slits and the shorter bottom side of the first conductor that is equivalent to a quarter wavelength of a desired first frequency.

13. The multi-band antenna apparatus according to claim 10, further comprising a distance between an other one of the plurality of slits and the shorter bottom side that is equivalent to a quarter wavelength of a first frequency.

14. The multi-band antenna apparatus according to claim 9, wherein the distance between the other of the plurality of slits and the shorter bottom side is equivalent to a quarter wavelength of a desired frequency different from the desired first frequency.

15. The multi-band antenna apparatus according to claim 9, wherein the first conductor, second conductor and the feeder comprises a bowtie antenna.

16. The multi-band antenna apparatus according to claim 9, wherein the plurality of slits have a width ranging from about 0.1 mm to about 0.3 mm.

17. The multi-band antenna apparatus according to claim 1, wherein a first end of the first portion is connected to the feeder, wherein the slit is provided at a second end of the first portion that is opposite to the first end, and wherein widths of the first and second portions increase with increasing distance from the first end.

18. A multi-band antenna apparatus comprising:

an antenna element having a first conductor and a second conductor, wherein the first conductor is divided by at least one slit into at least two portions, wherein the at least two portions of the first conductor are not electrically connected by a conductor; and a feeder for feeding power to a first conductor and a second conductor.

* * * * *